US006354228B1

(12) United States Patent
McPhee et al.

(10) Patent No.: US 6,354,228 B1
(45) Date of Patent: Mar. 12, 2002

(54) PALLET FORMED FROM INTERLOCKING MEMBERS

(76) Inventors: Bruce Alexander McPhee, Chandlers Lane, Wyong Creek, Wyong NSW 2259 (AU); Roger Milton Stevens, 17 Lorong Mydin, Singapore 1440 (SG)

( * ) Notice: Subject to any disclaimer, the term of this patent is extended or adjusted under 35 U.S.C. 154(b) by 0 days.

(21) Appl. No.: 08/793,464

(22) PCT Filed: Sep. 4, 1995

(86) PCT No.: PCT/AU95/00565

§ 371 Date: Jan. 24, 2000

§ 102(e) Date: Jan. 24, 2000

(87) PCT Pub. No.: WO96/07594

PCT Pub. Date: Mar. 14, 1996

(30) Foreign Application Priority Data

Sep. 2, 1994 (AU) ..... PM 7870
May 4, 1995 (AU) ..... PN 2746

(51) Int. Cl.[7] ..... B65D 19/00
(52) U.S. Cl. ..... 108/51.11; 108/56.1
(58) Field of Search ..... 108/56.3, 56.1, 108/51.11, 902, 901

(56) References Cited

U.S. PATENT DOCUMENTS 2,783,960 A * 3/1957 Herz et al. ..... 108/56.1
3,149,586 A * 9/1964 Kemp, Jr. et al. ..... 108/56.1
3,878,796 A 4/1975 Morrison
4,062,301 A 12/1977 Pitchford
4,145,976 A * 3/1979 Svirklys ..... 108/56.1
4,382,414 A 5/1983 Svirklys
5,333,555 A 8/1994 McPhee
5,365,857 A * 11/1994 Kilpatrick et al. ..... 108/56.1 X
5,365,859 A * 11/1994 Schrage ..... 108/902 X
5,417,167 A * 5/1995 Sadr ..... 108/902 X
5,458,069 A * 10/1995 Stolzman ..... 108/56.3
5,579,701 A * 12/1996 Fook Wah ..... 108/902 X
5,809,902 A * 9/1998 Zetterberg ..... 108/56.3 X
5,941,179 A * 8/1999 Herring ..... 108/56.3 X
6,105,512 A * 8/2000 Lin ..... 108/56.3

FOREIGN PATENT DOCUMENTS

| | | |
|---|---|---|
| AU | B1-17868/76 | 2/1980 |
| AU | A-68947/94 | 3/1995 |
| DE | 31 38 349 A1 | 4/1983 |
| GB | 1 388 759 | 3/1975 |
| GB | 1 564 495 | 11/1976 |

* cited by examiner

*Primary Examiner*—Jose V. Chen
(74) *Attorney, Agent, or Firm*—Larson & Taylor PLC

(57) ABSTRACT

A pallet including a pair of elongate bearers (3) and an upper deck and a lower deck of slats (5*a*, 5*b*) supported by the bearers (3). Each bearer (3) is generally trapezoidal in transverse section and includes upper and lower walls and inner and outer side walls (11*a*, 11*b*). Each bearer (3) further includes upper and lower openings (9*a*, 9*b*) which receive end sections of the slats (5*a*, 5*b*). The slats (5 *a*, 5*b* are retained securely by the bearers (3) without nails or other fasteners being required by interlocking end sections of the slats (5*a*, 5*b*) and the bearers (3).

19 Claims, 4 Drawing Sheets

PALLET FORMED FROM INTERLOCKING MEMBERS

The present invention relates to a pallet.

In particular, the present invention relates to a pallet of the type described in Australian patent 642,474 of Bruce Alexander McPhee (hereinafter referred to as "the McPhee pallet") which is constructed from steel bearers and wood planks or slats (hereinafter referred to as "slats"), without nails or other conventional fasteners.

An object of the present invention is to provide a pallet which is an improvement of the McPhee pallet.

According to the one aspect of the present invention there is provided a pallet comprising, a pair of elongate bearers, an upper deck and a lower deck supported by the bearers, each bearer having upper and lower openings which receive the end sections of the decks, and an outward facing surface of each deck being spaced above or below the bearers so that the outward facing surfaces of the decks and not the bearers contact adjacent pallets when a plurality of pallets are stacked one on top of the other.

It is preferred that each bearer comprise upper and lower walls and inner and outer side walls.

According to another aspect of the present invention there is provided a pallet comprising, a pair of elongate bearers, an upper deck and a lower deck supported by the bearers, each bearer having upper and lower walls and inner and outer side walls, each bearer having upper and lower openings which receive the end sections of the decks, and the upper and/or lower walls of each bearer tapering from the outer side wall to the inner side wall.

It is preferred that the included angle $\alpha$ between the inner side wall and one or both of the tapered upper wall and the tapered lower wall be greater than 90°.

It is preferred particularly that the included angle be greater than 95°.

It is preferred more particularly that each bearer be trapezoidal in transverse section.

According to another aspect of the present invention there is provided a pallet comprising, a pair of elongate bearers, an upper deck and a lower deck supported by the bearers, each bearer having upper and lower walls and inner and outer side walls which are fitted together without welding, riveting or fasteners and thereafter are hot-dip galvanised to hold the walls together, and each bearer having upper and lower openings which receive the end sections of the decks.

It is preferred that the upper and lower walls and inner and outer side walls be fitted together by interference fit or by snap lock assemblies.

It is preferred particularly that the upper and lower walls each comprise a plurality of spaced apart pressed wall sections.

It is preferred more particularly that the inner and outer side walls be roll-formed.

It is preferred that the end sections of the decks and the bearers be formed so that the decks are retained securely by the bearers without nails or other fasteners being required to hold the decks in position.

In one arrangement, it is preferred that the upper and lower decks comprise a plurality of slats.

It is preferred that the slats be retained securely by the bearers without nails or other fasteners being required by interlocking the end sections of the slats and the bearers.

It is preferred particularly that the slats and the bearers be interlocked by positioning each end section of each slat so that a reaction surface reacts against the outer side wall of the bearer in which the end section is received and so that a groove in the inwardly facing surface of each end section of each slat engages the inner side wall of the bearer in which the end section is received.

It is preferred that it be necessary to bow each end section to interlock the end sections with the bearers.

It is preferred particularly that the distance between the reaction surface and the groove of each end section of each slat be greater than the distance between the reaction surface of the outer side wall and the inner side wall of the bearers so that it is necessary to bow each end section to interlock the end sections with the bearers.

In an alternative arrangement it is preferred that the upper and lower decks be formed from a profiled steel sheeting.

It is preferred that the bearers be formed from steel.

It is preferred that the slats be formed from wood.

The present invention is described hereinafter by way of example with reference to the accompanying drawings in which.

The preferred embodiment of the pallet shown in FIGS. 1 to 4 comprises a pair of parallel spaced-apart elongate steel bearers 3 (only one of which is shown in the figures), an upper array of wood slats 5*a*, and a lower array of wood slats 5*b*.

Figure 1:
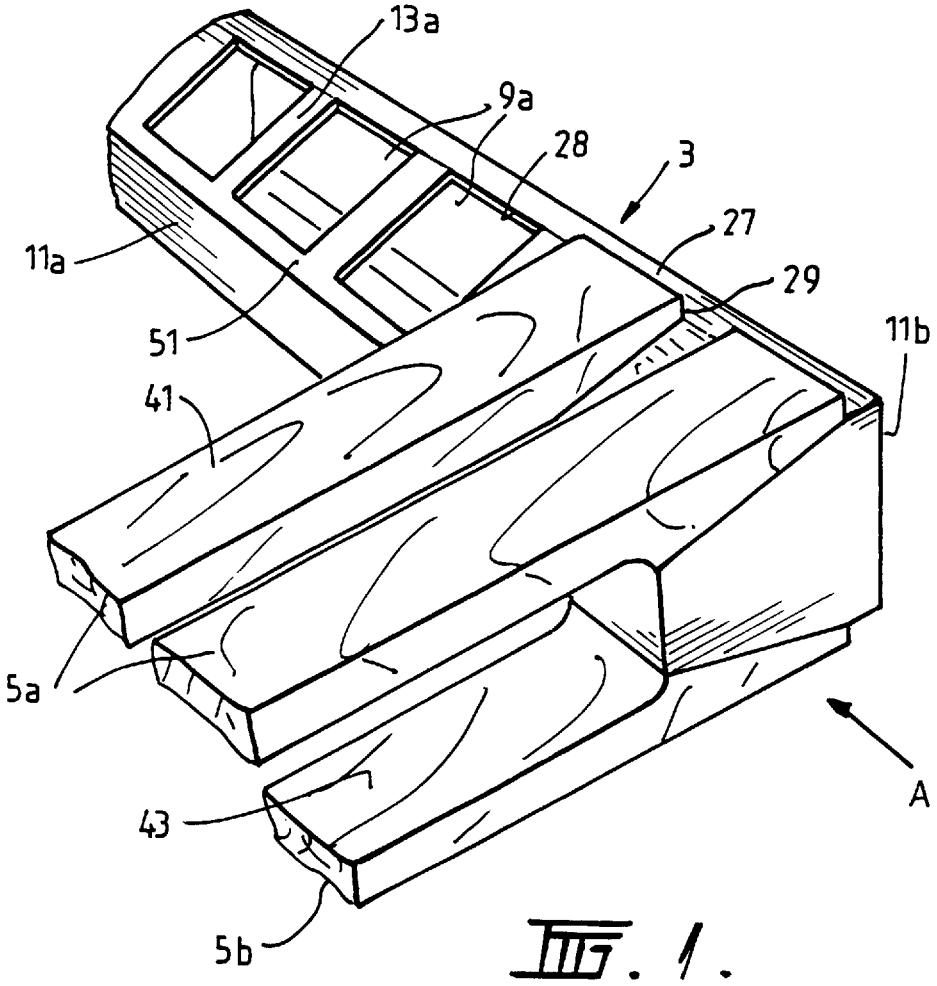
FIG. 1 is a perspective view of a section of one preferred embodiment of a pallet in accordance with the present invention with a number of slats removed for clarity.
Figure 4:
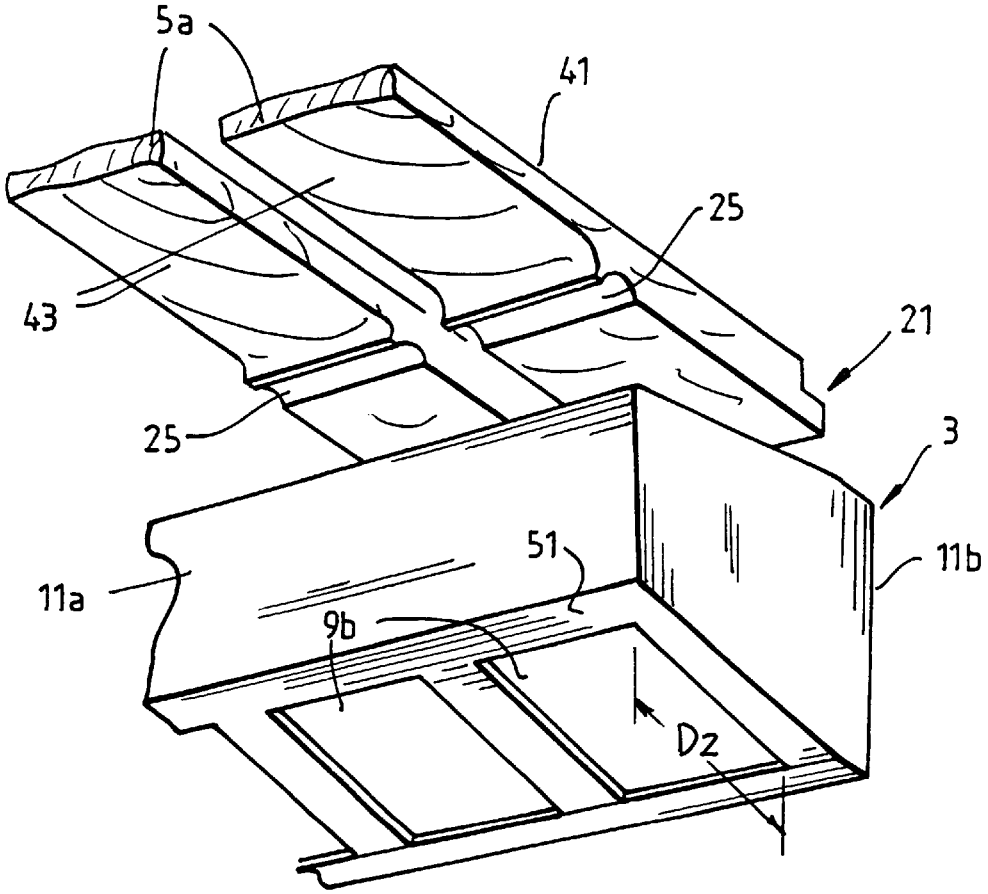
FIG. 4 is a perspective view of the section of the pallet shown in FIG. 1 from below the pallet with the lower array of slats removed for clarity and the upper array of slats shown in a position immediately prior to insertion of the slats into the bearer shown in the figure.

As can best be seen in FIGS. 1 and 4, each bearer 3 comprises upper rectangular openings 9*a* and lower rectangular openings 9*b* and the end section of each slat 5*a*, 5*b* is received in the associated openings 9*a*, 9*b*. As is described hereinafter in detail, the slats 5*a*, 5*b* and the bearers 3 are constructed so that the slats 5*a*, 5*b* are retained securely by the bearers 3 without nails or other fasteners being required to hold the slats 5*a*, 5*b* in position.

In the embodiment shown in FIGS. 1 to 4, each bearer 3 is formed by folding a flat sheet of steel which has cut-out sections that are positioned to form the openings 9*a*, 9*b* in the bearer 3.

Figure 2:
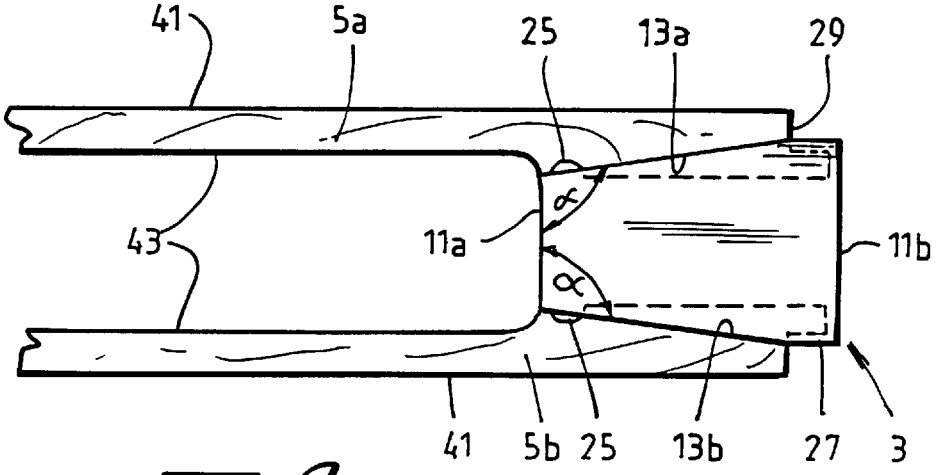
FIG. 2 is an end view of the pallet in the direction of the arrow A in FIG. 1.

With particular reference to FIG. 2, in accordance with one feature of the present invention, each bearer 3 comprises inner and outer side walls 11*a*, 11*b* and upper and lower walls 13*a*, 13*b* which taper from the outer side wall 11*b* towards the inner side wall 11*a* so that the bearers 3 are generally trapezoidal in transverse section. The openings 9*a*, 9*b* are formed in the tapered upper and lower walls 13*a*, 13*b*.

The tapering of the upper and lower walls 13*a*, 13*b* means that the included angle α (FIG. 2) between the inner side wall 11*a* and the tapered upper and lower walls 13*a*, 13*b* is greater than 90°, which is the conventional angle for bearers.

The applicant has found that the 90° angle of the conventional bearers forms sharp corners which dig into the soft fleshy parts of the hands of persons when the persons insert their hands between adjacent slats to grip the bearers and lift the conventional pallets. The applicant has found that the tapering of the upper and lower side walls 13*a*, 13*b* so that the included angle a is greater than 90° significantly alleviates this problem. This is a particularly important feature from the viewpoint of occupational health and safety considerations.

In addition, the applicant has found that tapering the upper and lower side walls 13*a*, 13*b* reduces the amount of material required, and therefore the weight, of the bearers 3. In addition, the applicant has found that the trapezoidal section bearers 3 have improved stiffness when compared with conventional square section bearers.

In accordance with another feature of the present invention, after folding the sheet steel to form the bearers 3, the bearers are hot-dip galvanised. It has been found surprisingly by the applicant that the coating formed by this process is sufficiently strong to hold together the bearers 3 and that, as a consequence, rivets, spot welding, and other conventional means of retaining the shape of the folded steel sheet are not required. This is an important feature from the viewpoint of minimising manufacturing costs.

Figure 3:
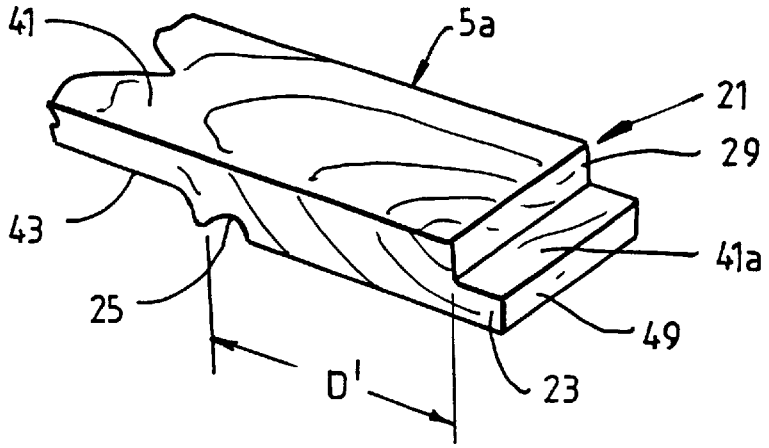
FIG. 3 is a perspective view of an end section of one of the upper slats shown in FIGS. 1 and 2.

With particular reference to FIG. 3, in accordance with another feature of the present invention, as is described in more detail hereinafter, each slat 5*a*, 5*b* is formed so that the outwardly facing surfaces 41 of the slats 5*a*, 5*b* extend above or below the upper and lower walls 13*a*, 13*b* of the bearers 3. The arrangement increases frictional contact between the pallet and an underlying surface, when compared with the contact surface area of the McPhee pallet. The increased contact surface area is important from the viewpoint of occupational health and safety considerations.

In accordance with another feature of the present invention the slats 5*a*, 5*b* are securely retained by the bearers 3 without the necessity to use nails or other fasteners. This is achieved in the preferred embodiment shown in FIGS. 1 to 4 by forming the slats 5*a*, 5*b* and the bearers 3 so that these components interlock. It is noted that it is a significant benefit in terms of minimising manufacturing costs to be able to provide a pallet which does not require nails or other fasteners to hold together the slats and the bearers. In addition, such a pallet avoids damage to products being transported which is often caused by nails and other fasteners used in conventional pallets.

In this connection, with reference to FIGS. 2 and 4, each end section of the slats 5*a*, 5*b* comprises a tongue 23. The tongue 23 is formed by a downward step 21 in the outwardly facing surface 41 at each end section of the slats 5*a*, 5*b*, with the downward step 21 having an upright shoulder 29.

The above arrangement allows the tongue 23 to extend through the openings 9*a*, 9*b* inwardly of narrow wall sections 27 of the upper or lower walls 13*a*, 13*b* that are adjacent the outer side walls 11*b* of the bearers 3. Specifically, when a slat 5*a*, 5*b* is positioned correctly:

(i) the shoulder 29 of the step 21 contacts the edge 28 of the narrow wall section 27, and/or;

(ii) the end 49 of the tongue 23 contacts the inner surface of the outer side wall 11*b* and/or;

(iii) the outwardly facing surface 41*a* of the tongue 23 contacts the inner surface of the narrow wall section 27.

It is noted that the height of the shoulder 29 determines in large part the extent to which the outwardly facing surfaces 41 of the slats 5*a*, 5*b* extend above or below the lower walls 13*a*, 13*b* of the bearers 3.

Furthermore, with reference to FIGS. 3 and 4, the inward facing surface 43 of each end section of the slats 5*a*, 5*b* includes a groove 25 which is adapted to be positioned to receive the upper or lower ends 51 of the inner side wall 11*a* that are adjacent to and in part form the openings 9*a*, 9*b*.

It can readily be appreciated that, with appropriate selection of the dimensions of the slats 5*a*, 5*b* and the bearers 3, the groove 25 and the tongue 23/shoulder 29 at each end of each slat 5*a*, 5*b* co-operate with the associated bearer 3 to securely interlock the slats 5*a*, 5*b* and the bearers 3 without the necessity to use nails or other fasteners.

The distance $D_1$ (FIG. 3) between the grooves 25 and the shoulders 29 of each slat 5*a*, 5*b*, is greater than the distance $D_2$ (FIG. 4) between the upper or lower ends 51 of the inner side wall 11*a* and the edges 28 of the narrow wall sections 27 of the bearers 3. As a consequence, in order to interlock a slat 5*a*, 5*b* and the bearers 3 it is necessary to bow the end sections of the slat 5*a*, 5*b*. The effect of bowing the end sections of the slats 5*a*, 5*b* is to make it very difficult to disconnect the slats 5*a*, 5*b* from the bearers 3.

The preferred embodiment of the pallet shown in FIGS. 5 to 8 is similar in many respects to the embodiment shown in FIGS. 1 to 4. The main difference between the two embodiments is the construction of the bearers 3.

With reference to FIGS. 5 to 8, each bearer 3 is formed from a number of separate components which are held together initially by interference fit or snap-lock assemblies (or any other suitable means other than welding, riveting or conventional fasteners) and thereafter are hot-dip galvanised to form a strong assembly.

Figure 5:
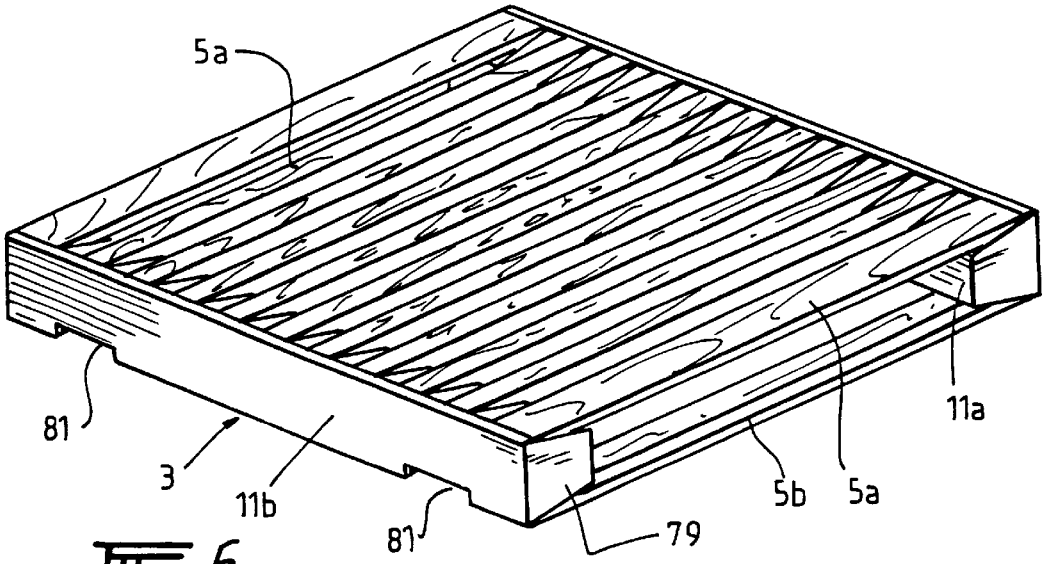
FIG. 5 is a perspective view of another preferred embodiment of a pallet in accordance with the present invention which differs from the embodiment shown in FIGS. 1 to 4 in the construction of the bearers.
Figure 6:
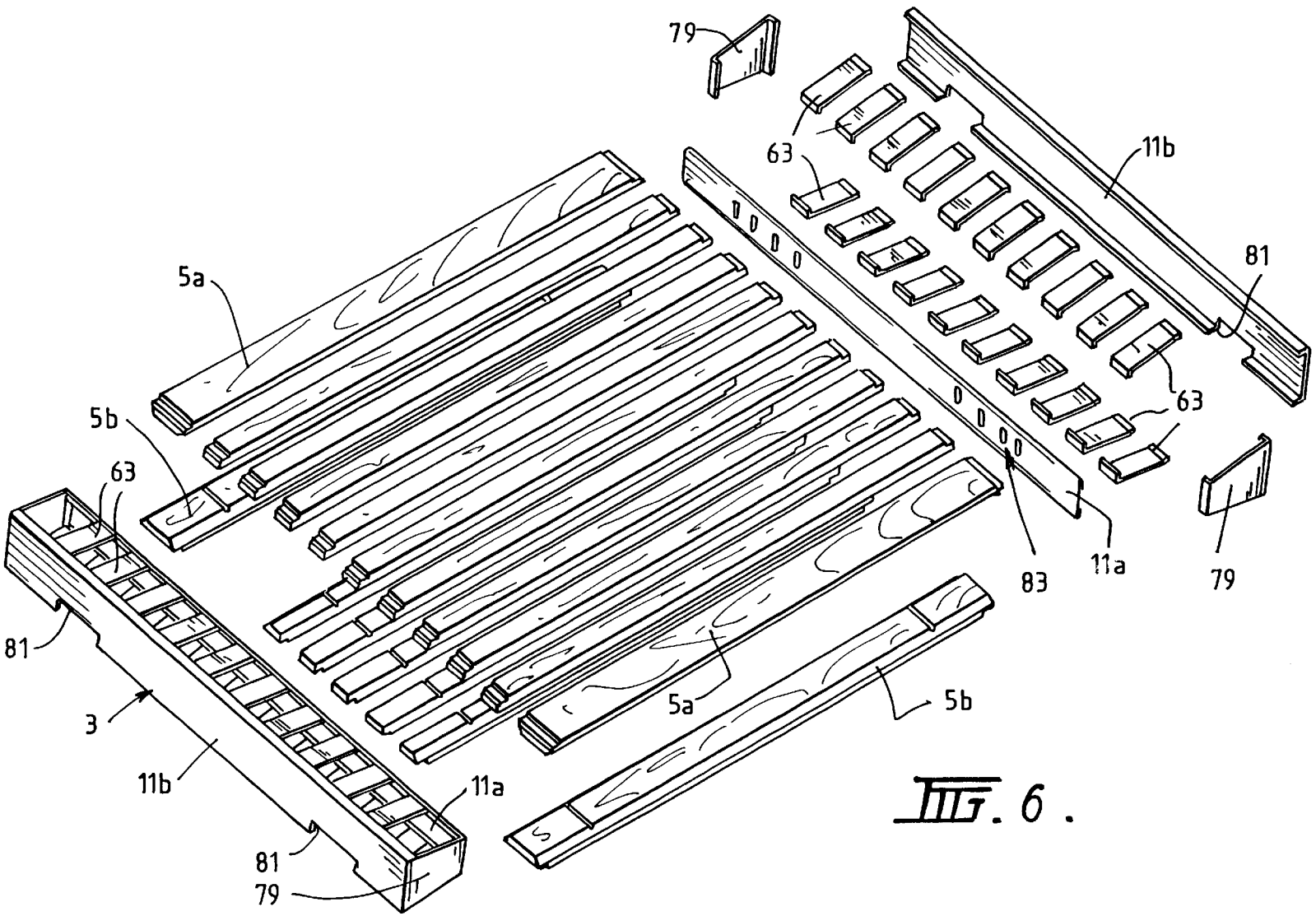
FIG. 6 is an exploded perspective view of the pallet shown in FIG. 5 which illustrates general detail of the components of the pallet.

With further reference to FIGS. 5 and 6, the components comprise, separate inner and outer roll-formed side walls 11*a*, 11*b* and upper and lower pressed wall sections 63.

The components also comprise pressed end wall panels 79 which close the ends of the bearers 3.

Figure 7:
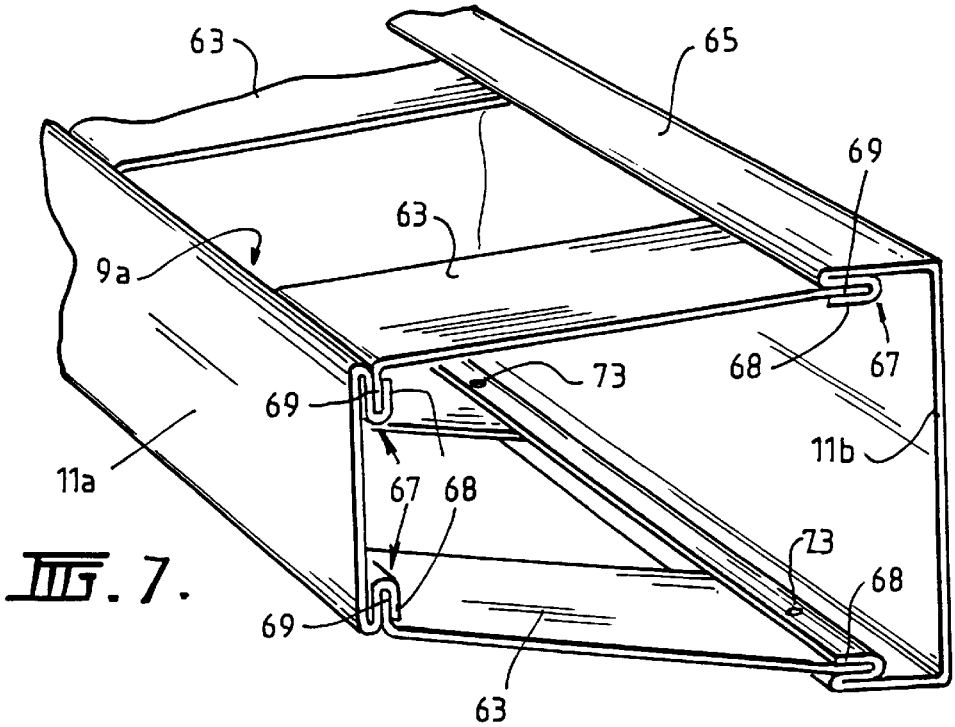
FIG. 7 is a perspective view illustrating the component parts of a bearer of the pallet shown in FIGS. 5 and 6.
Figure 8:
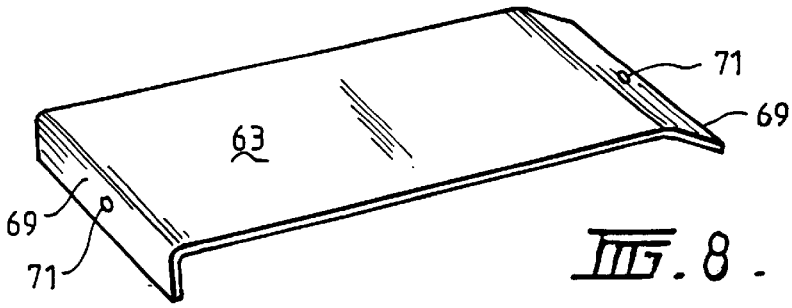
FIG. 8 is a perspective view of an upper wall element of the bearer of the pallet shown in FIGS. 5 to 7.

With reference to FIGS. 7 and 8, the side walls 11*a*, 11*b* terminate in elongate outwardly opening channels 67. The inner faces 68 of the channels 67 include drilled holes 73 at spaced intervals. The channels 67 and the drilled holes 73 form part of a snap-lock assembly to hold together the side walls 11*a*, 11*b* and the wall sections 63.

The outer side wall 11*b* also includes upper and lower flanges 65 which extend inwardly at right angles to the plane of the outer side wall 11*b*.

The upper and lower wall sections 63 are generally rectangular and comprise flanges 69 at opposite ends. The flanges 69 include projections 71 which are adapted to cooperate with the holes 73 in the channels 67 of the side walls 11*a*, 11*b*. The flanges 69 and the projections 71 also form part of the snap-lock assembly to hold together the side walls 11*a*, 11*b* and the wall sections 63.

In order to assemble the bearer 3 shown in FIGS. 5 to 8, the flanges 69 of the upper and lower wall sections 63 are inserted into the channels 67 of the side walls 11*a*, 11*b* so that the projections 71 on the flanges 69 extend into and are retained in the holes 73 in the channels 67. Thereafter, the end panels 79 are fitted onto the ends of the assembly of the side walls 11*a*, 11*b* and the upper and lower wall sections 63. The final step comprises hot-dip galvanising the assembled bearer 3. As indicated above, it has been found surprisingly by the applicant that the coating formed provides sufficient strength and that as a consequence welding, riveting, or fasteners are not required.

With further reference to FIGS. 5 and 6, each bearer 3 further comprises a pair of cut-outs 81 which allow the pallet to lock into a pallet racking system.

Furthermore, each bearer 3 comprises strengthening ribs 83, shown by way of example in FIG. 5 in the inner side wall 11*a*, to increase the load carrying capacity of the pallet. This is a particularly useful feature when the pallet is used in a racking situation.

Many modifications may be made to the preferred embodiment of the pallet of the present invention described above without departing from the spirit and scope of the present invention.

By way of example, whilst the preferred embodiment comprises bearers 3 formed from steel and slats 5*a*, 5*b* formed from wood, it can readily be appreciated that the present invention is not so limited and the bearers and slats may be formed from any suitable material.

What is claimed is:

1. A pallet comprising, a pair of elongate bearers, an upper deck and a lower deck supported by the bearers, each bearer having upper and lower openings which receive associated end sections of the decks, and an outward facing surface of each deck being spaced above or below the bearers so that the outward facing surfaces of the decks and not the bearers contact adjacent pallets when a plurality of pallets are stacked one on top of the other.

2. The pallet defined in claim 1 wherein each bearer comprises upper and lower walls and inner and outer side walls.

3. A pallet comprising, a pair of elongate bearers, an upper deck and a lower deck supported by the bearers, each bearer having upper and lower walls and inner and outer side walls, each bearer having upper and lower openings which receive associated end sections of the decks, and the upper and/or lower walls of each bearer tapering from the outer side wall to the inner side wall.

4. The pallet defined in claim 3 wherein an included angle a between the inner side wall and one of an associated tapered upper wall or tapered lower wall is greater than 90°.

5. The pallet defined in claim 4 wherein the included angle $\alpha$ is greater than 95°.

6. The pallet defined in claim 3 wherein each bearer is trapezoidal in transverse section.

7. The pallet defined in claim 3 wherein the upper and lower walls and inner and outer side walls are fitted together by interference fit or by snap lock assemblies.

8. The pallet defined in claim 3 wherein the upper and lower walls each comprise a plurality of spaced apart pressed wall sections.

9. The pallet defined in claim 3 wherein the inner and outer side walls are roll-formed.

10. The pallet defined in claim 3 wherein the end sections of the decks and the bearers are formed so that the decks are retained securely by the bearers without nails or other fasteners being required to hold the decks in position.

11. The pallet defined in claim 2 wherein the upper and lower walls and inner and outer side walls are fitted together by interference fit or by snap lock assemblies.

12. The pallet defined in claim 2 wherein the upper and lower walls each comprise a plurality of spaced apart pressed wall sections.

13. The pallet defined in claim 2 wherein the inner and outer side walls are roll-formed.

14. The pallet defined in claim 1 wherein the end sections of the decks and the bearers are formed so that the decks are retained securely by the bearers without nails or other fasteners being required to hold the decks in position.

15. The pallet defined in claim 11 wherein the upper and lower decks comprise a plurality of slats.

16. The pallet defined in claim 12 wherein the slats are securely retained by the bearers without nails or other fasteners being required by interlocking associated end sections of the slats and the bearers.

17. The pallet defined in claim 16 wherein the slats and the bearers are interlocked by positioning each end section of each slat so that a reaction surface reacts against the outer side wall of the bearer in which the end section is received and so that a groove in an associated inwardly facing surface of each end section of each slat engages the inner side walls of the bearer in which the end section is received.

18. The pallet defined in claim 16 wherein it is necessary to bow each end section of each slat to interlock the end sections with the bearers.

19. The pallet defined in claim 14 wherein the upper and lower decks are formed from a profiled steel sheeting.

* * * * *